US005620832A

United States Patent [19]

Sung et al.

[11] Patent Number: 5,620,832

[45] Date of Patent: Apr. 15, 1997

[54] FIELD EMISSION DISPLAY AND METHOD FOR FABRICATING THE SAME

[75] Inventors: Kang H. Sung; Chang W. Huh, both of Seoul, Rep. of Korea

[73] Assignee: LG Electronics Inc., Seoul, Rep. of Korea

[21] Appl. No.: 421,881

[22] Filed: Apr. 14, 1995

[51] Int. Cl.[6] ..... G03C 5/00

[52] U.S. Cl. ..... 430/311; 430/312; 430/314; 216/11

[58] Field of Search ..... 430/311, 312, 430/313, 314; 156/643.1, 644.1; 437/927

[56] References Cited

U.S. PATENT DOCUMENTS 4,968,585 11/1990 Albrecht et al. ..... 430/320
5,391,259 2/1995 Cathey et al. ..... 156/643
5,461,009 10/1995 Huang et al. ..... 437/228

*Primary Examiner*—S. Rosasco

[57] ABSTRACT

A field emission display, and method of making, including: a first substrate; a transparent electrode formed on the first substrate; a fluorescent layer of emitting light formed on a predetermined area of the transparent electrode; an insulating layer formed around the fluorescent layer on the other areas of the transparent electrode; a gate electrode formed on the insulating layer; a second substrate; a conductive cathode layer formed on the second substrate; and a tip for emitting electrons formed on the conductive cathode layer, the tip being aligned with the fluorescent layer in such a way that they may stand opposed to each other at a distance under a vacuum condition. The electrons are emitted from the tip of the fluorescent layer under control of the gate electrode. The tip is formed by taper-etching the tip layer in a RIE process. Subsequent evaporation of the tip to sharpen it is not necessary. This simplifies, and cuts the cost of, fabrication of the FED.

12 Claims, 6 Drawing Sheets

CONVENTIONAL. ART

CONVENTIONAL. ART

CONVENTIONAL. ART

CONVENTIONAL. ART

CONVENTIONAL. ART

CONVENTIONAL. ART

CONVENTIONAL. ART

FIELD EMISSION DISPLAY AND METHOD FOR FABRICATING THE SAME

BACKGROUND OF THE INVENTION

1. Field of the Invention

The present invention relates, in general, to a field emission display (hereinafter referred to as "FED") and, more particularly, to a FED which has a tip of emitting electrons formed by slant etch. Also, the present invention is concerned with methods for fabricating the same.

2. Description of the Prior Art

A FED typically includes an electron emitter, a controller, and a light emitter. In a FED, electrons are generated in the electron emitter and proceed into a target under control of the controller. The electrons bombard with a fluorescent layer, a target, and then light is emitted therefrom. A tip, an essential component responsible for emitting the electrons in a FED, should be capable of transferring the electrons generated in a conductive cathode and accordingly, may be made of any conductive material. Presently, those materials such as silicon or metals have widely been used for the tip. However, silicon is virtually impossible to employ on a glass substrate.

In order to better understand the background of the invention, a description for conventional technique will be given below with reference to some figures.

Referring to FIG. 1, there is shown a conventional FED. As shown in this figure, the FED is comprised of two substrates, a lower glass substrate 10 and an upper glass substrate 15, and a functional structure sandwiched therebetween, wherein a conductive cathode layer 11 atop the lower glass substrate 10 has a tip 12 on a central area of its surface and an insulating layer 13 capped with a gate electrode 14 on the other area and a transparent electrode 16 underneath the upper glass substrate 15 is provided with a fluorescent layer 17 (for emitting light) at a central area of the lower surface thereof. The tip 12 is aligned with the fluorescent layer 17 in such a way that they may stand opposed to each other at a distance under a vacuum condition.

With regard to functions of the components, as mentioned above, the tip 12 emits electrons and the fluorescent layer 17 emits light as a result of the bombardment of the electrons, while the direction of the electrons is under control of the gate electrode 14.

FIG. 2 illustrates fabrication processes for the conventional FED. These fabrication processes are described in connection with FIGS. 2A through 2F.

With reference to FIG. 2A, a cathode layer 11, an insulating layer 13 and a gate electrode layer are in sequence deposited entirely over a glass substrate 10 by a sputtering or CVD process, and a central part of the gate electrode layer is taken off by a combination of photomasking process and reactive ion etching (hereinafter referred to as "RIE") process, to form a gate electrode 14 responsible for controlling the emission of electron.

With reference to FIG. 2B, the insulating layer 13 is subjected to wet chemical etching or RIE, to expose a predetermined area of the conductive cathode layer 11, with the gate electrode 14 serving as a mask. At the moment, the insulating layer is over-etched in order to provide a space wherein, as will be described later, a sharp-pointed tip is formed.

With reference to FIG. 2C, a nickel layer is deposited entirely over the gate electrode 14 and patterned to form a mask layer 18 which is used for depositing a tip layer later, followed by deposition of a tip layer 19 on both the mask layer 18 and the exposed area of the conductive cathode layer 11. Upon evaporating the tip layer 19, a tip 12 is formed on the exposed area of the glass substrate 10 at an angle of 75 degrees to the surface of the glass substrate 10 since the glass substrate 10 is rotated.

With reference to FIG. 2D, an electrochemical etching process is executed so as to eliminate the mask layer of nickel 18 as well as the tip layer 19.

Separately from the processes illustrated in FIGS. 2A to 2D, a blank transparent electrode 16, as shown in FIG. 2E, is deposited over another glass substrate 15, followed by deposition of a fluorescent layer 17 of phosphor on the transparent electrode 16. The fluorescent layer 17 is patterned by photolithography, to prepare it for emitting light.

With reference to FIG. 2F, the tip 12 is aligned with the fluorescent layer 17 in such a manner that they may stand opposed to each other at a distance with vacuum maintained therebetween.

In such conventional FED, when an electric field of a considerable amount of negative voltage, for example, about −200 to about −1000 volts, is applied to the tip 12, electrons are emitted from the tip 12. Light is illuminated from the fluorescent layer 17 when the emitted electrons bombard the fluorescent layer 17 (which is applied with some positive voltages.)

If some positive volts are applied to the gate electrode 14, the electrons emitted from the tip 12 cannot reach the fluorescent layer 17 but are absorbed in the gate electrode 14 and thus, no light is emitted.

As stated above, whether the fluorescent layer 17 emits light or not is determined by varying the voltage applied to the gate electrode 14 under the condition that desirable values are set on the respective voltages applied to the tip 12, an electron emitter, and the fluorescent layer 17, a light emitter.

Establishment of vacuum state in the FED is intended to transfer electrons from the tip 12 to the fluorescent layer 17 only by electric field.

However, since the tip is formed on the conductive cathode (by evaporating the tip layer) on the glass substrate at an angle of 75 degrees to the surface of the glass substrate, the fabrication processes for the conventional FED are considerably difficulty to perform in addition to being complicated. So, the fraction of conventionally manufactured FEDs that are defective is very high. Further, the mask layer is only a temporary structure used while forming the tip. As a result, this nickel layer is sacrificial, i.e., not retained in the FED, which increases the production cost of the FED.

SUMMARY OF THE INVENTION

Therefore, an object of the present invention is to overcome the above problems encountered in prior arts and to provide a FED, improved and production cost and in the number of units that have defects.

It is another object of the present invention to provide a simple method for fabricating a FED.

It is a further object of the present invention to the method for fabricating a FED, capable of forming the tip, without a step of evaporating it, an angle of 75 degrees to the surface of the conductive cathode layer.

In accordance with a view of the invention, there is provided a field emission display, comprising: a first substrate; a transparent electrode which is formed on the first substrate; a fluorescent layer of emitting light which is formed on a predetermined area of the transparent electrode; an insulating layer which is formed around the fluorescent layer on the other areas of the transparent electrode; a gate electrode which is formed on the insulating layer; a second substrate; a conductive cathode layer which is formed on the second substrate; and a tip for emitting electrons which is formed on the conductive cathode layer, said tip being aligned with said fluorescent layer in such a way that they stand opposed to each other at a distance under a vacuum condition and said electrons being emitted from said tip to said fluorescent layer are under control of said gate electrode.

In accordance with another view of the invention, there is provided a method for fabricating a field emission display, comprising the steps of: depositing a transparent electrode layer, an insulating layer and a gate electrode layer on a first substrate, in due order; selectively etching the gate electrode, to form a gate electrode; subjecting the insulating layer to etch, to expose a predetermined area of the transparent electrode with the gate electrode serving as a mask; forming a fluorescent layer of emitting light on the exposed area of the transparent electrode; forming a conductive cathode layer on a second substrate; and forming a tip of emitting electrons on a predetermined area of the conductive cathode layer.

In accordance with a further view of the invention, there is provided a method for fabricating a field emission display, comprising the steps of: depositing a conductive cathode layer on a first substrate and then, forming a tip of emitting electrons on a predetermined area of the conductive cathode layer; forming an insulating layer and a gate electrode layer on the other area of the conductive cathode layer, in due order; and forming a transparent electrode and a fluorescent layer on a second substrate, in sequence.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

Figure 1:
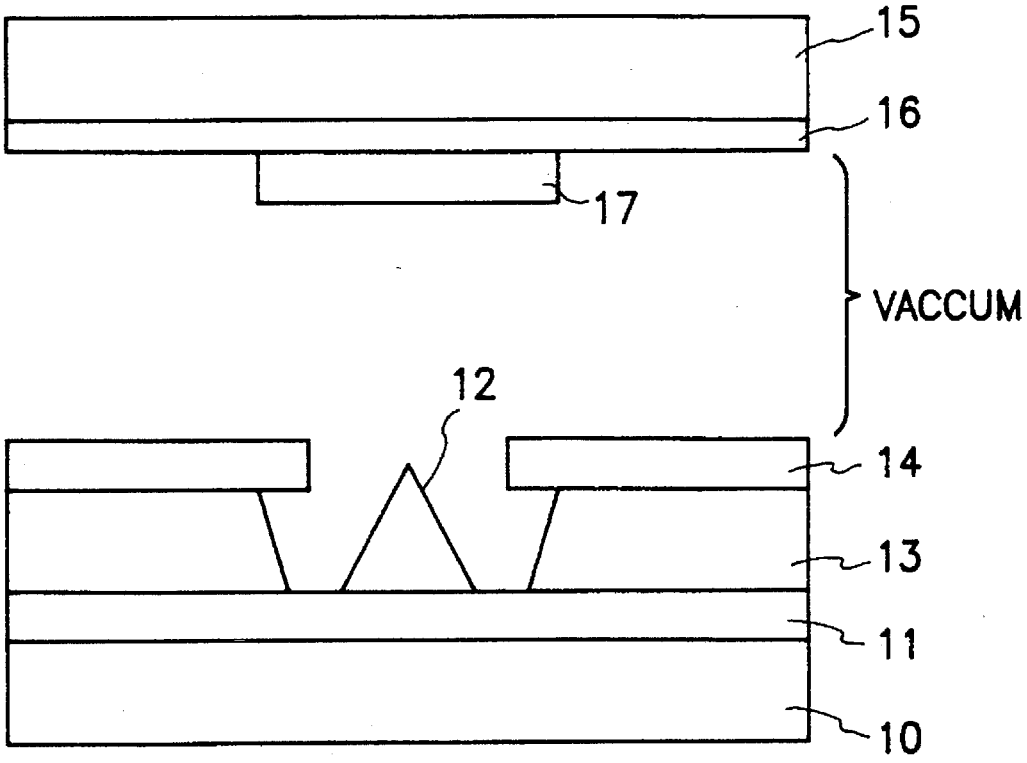
FIG. 1 is a schematic cross sectional view showing a conventional FED.
Figure 2A:
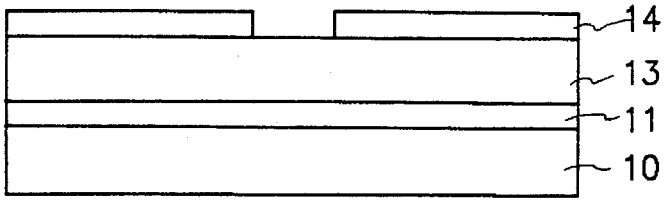
FIGS. 2A through 2F are schematic cross sectional views illustrating a conventional method for fabricating the FED of FIG. 1.
Figure 2B:
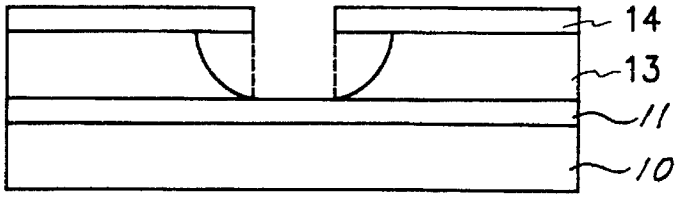
Figure 2C:
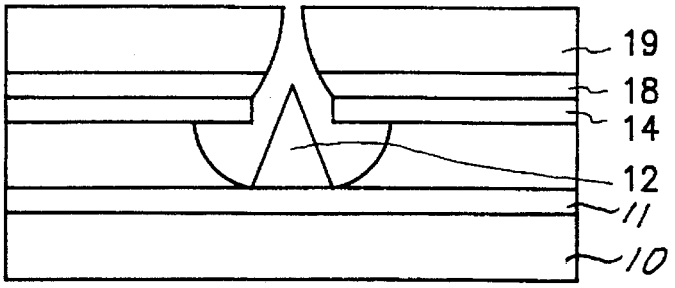
Figure 2D:
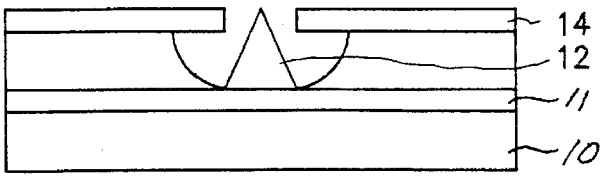
Figure 2E:
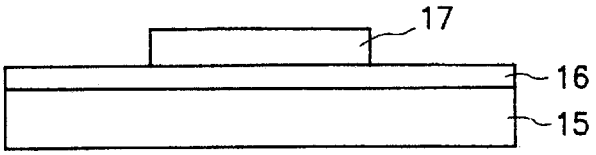
Figure 2F:
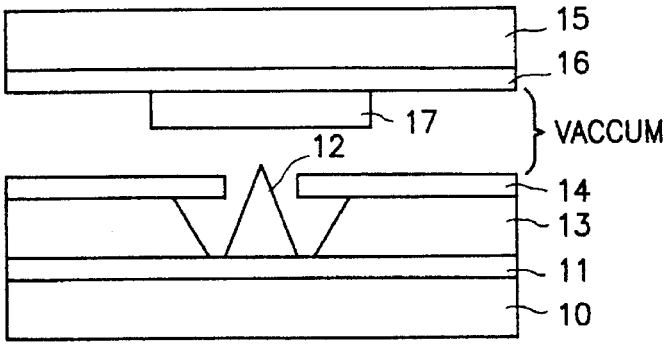

The application of the preferred embodiments of the present invention is best understood with reference to the accompanying drawings, wherein like reference numerals are used for like and corresponding parts, respectively.

Figure 3:
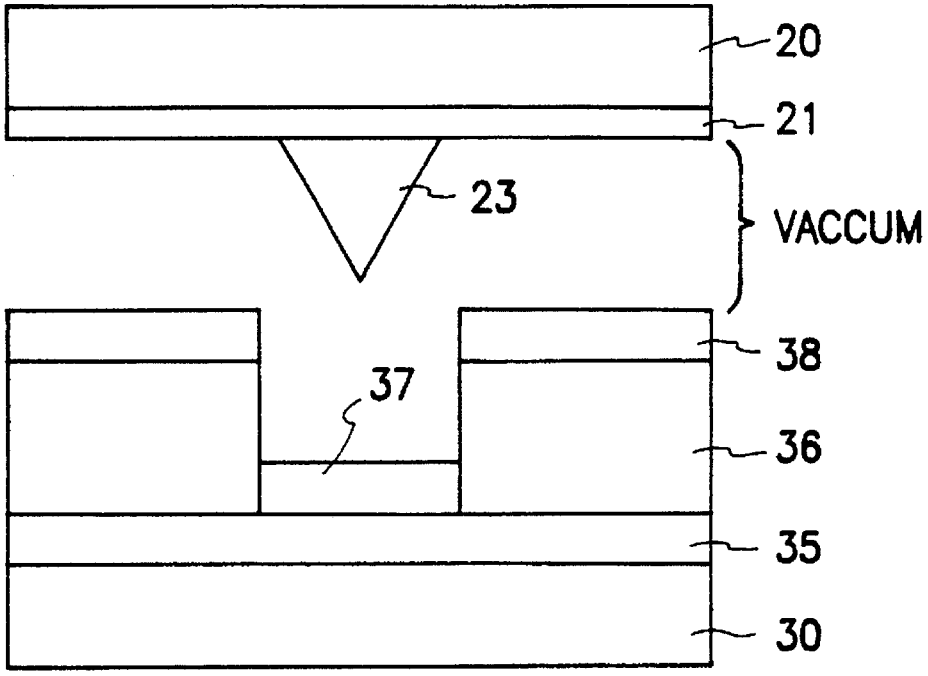
FIG. 3 is a schematic cross sectional view showing a FED according to the present invention.

Referring initially to FIG. 3, there is shown a FED according to the present invention. As shown in this figure, the FED is comprised of two substrates, an upper glass substrate 20 and a lower glass substrate 30, and a functional structure sandwiched therebetween, wherein a conductive cathode layer 21 underneath the upper glass substrate 20 affixes a tip 23 to a central area of the lower surface thereof and a transparent electrode 35 atop the lower glass substrate 30 has a fluorescent layer 37 on a central area of its surface and an insulating layer 36 capped with a gate electrode 38 on the other areas. In the FED, the integrated body of the upper glass substrate 20 is apart from that of the lower glass substrate 30 with vacuum maintained therebetween, in such a way that the tip 23 may be aligned with the fluorescent layer 37. With regard to functions of the components, the tip 23 emits electrons and the fluorescent layer 37 emits light as a result of the bombardment of the electrons, while the electrons are under control of the gate electrode 38.

Referring now to FIG. 4, there is a preferred embodiment of a method for fabricating the FED of the present invention. This embodiment will be in detail described in connection with FIGS. 4A through 4E.

Figure 4A:
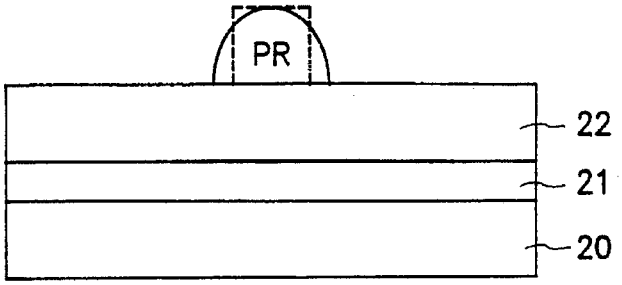
FIGS. 4A through 4E are schematic cross sectional views showing a method for fabricating a FED, according to an embodiment of the present invention.

First, as shown in FIG. 4A, a conductive cathode layer 21 and a tip layer 22 are sequentially formed over a glass substrate 20, followed by formation of a patterned photoresist with a size of 2 μm×2 μm (represented by dotted line) on a predetermined area of the tip layer 22. Thereafter, the patterned photoresist is reshaped. (such as represented by solid line) by flowing down the upper edges of the patterned photoresist with heat, for example, baking it.

Figure 4B:
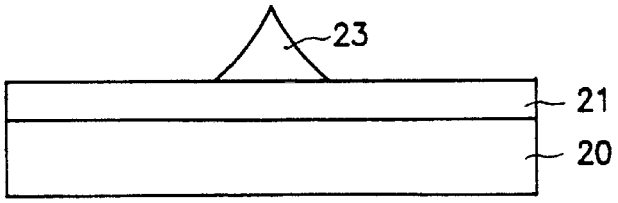

Next, as shown in FIG. 4B, while the reshaped photoresist serving as a mask, an RIE process using a mixture of etchant gas and oxygen gas is applied to the tip layer 22, to form a sharp-pointed tip 23 on a central area of the conductive cathode layer 21. The formation of the sharp-pointed tip 23 is based on a fact that the etching rate is slower in the area of the tip layer 22 masked with the reshaped photoresist than in the other areas unmasked.

Figure 4C:
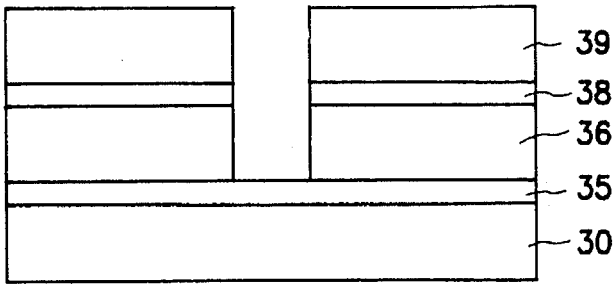

Then, as shown in FIG. 4C, a separate glass substrate 30 is prepared for depositing a transparent electrode 35, an insulating layer 36, a gate electrode layer 38, and a photoresist layer 39 entirely thereon, in due order, and a hole is formed which exposes a predetermined area of the transparent electrode 35. For formation of the hole, the blanket photoresist layer 39 is patterned by an ordinary photolithography process and then, until the surface of the transparent electrode 35 is exposed, the gate electrode layer 38 and the insulating layer 36 are etched while using the patterned photoresist layer 39 as a mask.

Figure 4D:
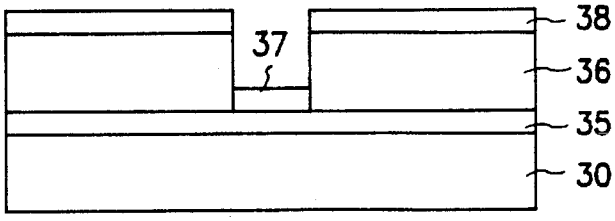

Thereafter, as shown in FIG. 4D, a fluorescent layer 37 of phosphor is deposited entirely over the resulting structure of FIG. 4C and then, the photoresist layer 39 is removed. In result, the fluorescent layer 37 remains only on the exposed area of the transparent electrode 35.

Figure 4E:
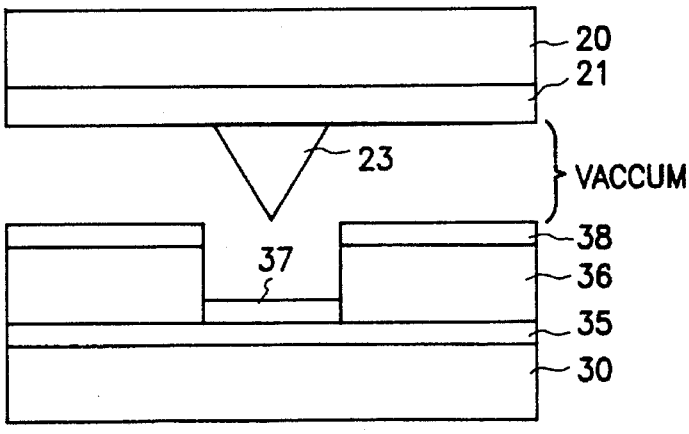

Finally, as shown in FIG. 4E, the tip 23 is aligned with the fluorescent layer in such a way that they may stand opposed to each other at a distance under a vacuum condition. So, the FED of the invention is completed.

In the FED fabricated according to an embodiment of the present invention, electrons are generated from the tip 23 by applying an electric field of a considerable amount of negative voltage, for example, −200 to −1,000 voltages, to the tip 23. At the moment, application of positive voltages to the gate electrode 38 and/or the fluorescent layer 37 allows the generated electrons to advance to them.

As stated above, since the gate electrode 38 and fluorescent 37 which both are formed over the one glass substrate 30 are separated from the tip 23 formed the other glass substrate 20, there is hardly generated a problem of short circuit in the FED of the present invention. To safely avoid the short circuit problem, it is preferred that the insulating layer 36 is at least about 2,000 Angstrom thick in consideration of the difference of a few voltages between the gate electrode 38 and the fluorescent layer 37.

With regard to mechanism of light emission in the FED, it is dependent upon the relation among the voltages applied to the conductive cathode layer 21, the gate electrode 38 and the fluorescent layer 37. The electrons which are generated from the tip 23 with negative electrical potential are transferred to either the gate electrode 38 or the fluorescent layer 37. If the electrical potential of the gate electrode 38 is the same with that of the conductive cathode layer 21 or high relative to that of the fluorescent layer 37, the electrons are emitted into the electrode gate 38, the electron controller. On the other hand, if the electrical potential of the gate electrode 38 is lower than that of the fluorescent layer 37, the electrons bombard the fluorescent layer 37, so as to emit light therefrom. In other words, the transfer of electron from the electron emitter to the light emitter can be controlled by varying the electric field of the gate electrode under condition that the voltages applied to the electron emitter and the light emitter are fixed at desirable respective values.

Turning now to FIG. 5, there is another preferred embodiment of the present invention that illustrates a method for fabricating a FED.

Figure 5A:
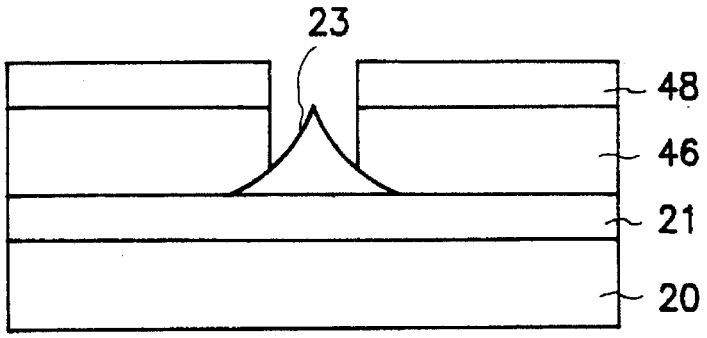
FIGS. 5A through 5C are schematic cross sectional views showing a method for fabricating a FED, according to another embodiment of the present invention.

First, with reference to FIG. 5A, a sharp-pointed tip 23 is formed on a central area of surface of a conductive cathode layer 21 atop a glass substrate 20 by repeating the same procedure as in FIGS. 4A and 4B and then are an insulating layer 46 and a gate electrode layer 48 deposited sequentially over the resulting structure, followed by performing photolithography on the gate electrode layer 48. As a result of the photolithography, the gate electrode layer 48 is selectively etched to form a gate electrode, which is in turn used as an etching mask when the insulating layer 46 is patterned.

Figure 5B:
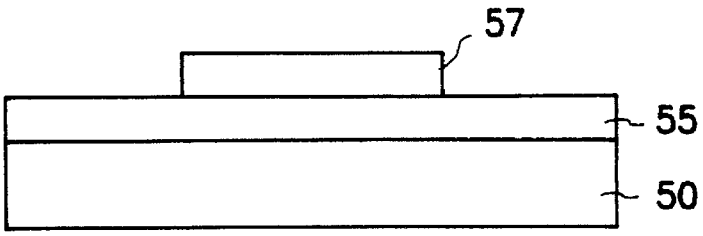

With reference to FIG. 5B, a separate glass substrate 50 is prepared for depositing a transparent electrode 55 and a fluorescent layer 57 of phosphor, in sequence, on it, followed by patterning the fluorescent layer 57 with photolithography.

Figure 5C:
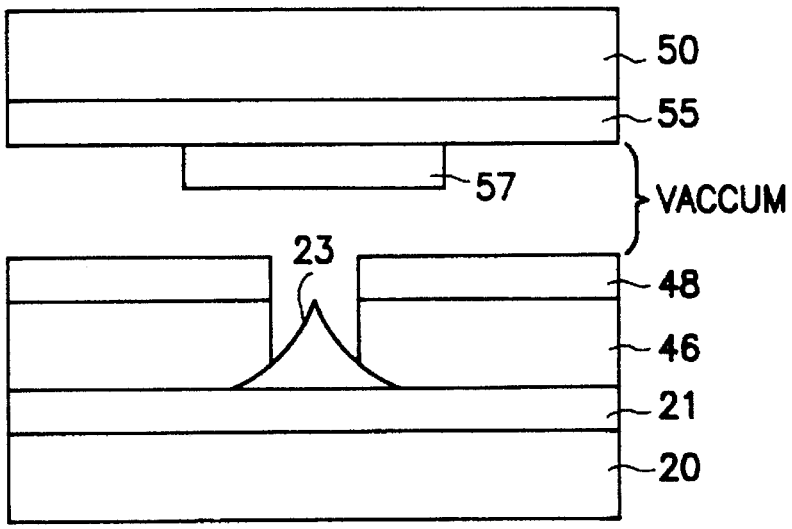

Finally, with reference to FIG. 5C, the tip 23 is aligned with the fluorescent layer 57 in such a way that they may stand opposed to each other at a distance under a vacuum condition.

As described hereinbefore, the tip, an electron emitter of the FED, is easily formed by taper etch, according to the present invention and thus, the fabrication processes for the FED can be simplified, thereby increasing the production yield and effecting cost down.

Other features, advantages and embodiments of the invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A field emission display, comprising:

a first substrate;

a transparent electrode formed on the first substrate;

a fluorescent layer formed on a predetermined area of the transparent electrode;

an insulating layer formed around the fluorescent layer on the other areas of the transparent electrode;

a gate electrode formed on the insulating layer;

a second substrate;

a conductive cathode layer formed on the second substrate; and a tip for emitting electrons formed on the conductive cathode layer, said tip being aligned with said fluorescent layer in such a way that the tip and the fluorescent layer stand opposed to each other, said electrons being emitted from said tip to said fluorescent layer under control of said gate electrode.

2. A field emission display in accordance with claim 1, wherein a vacuum condition exists in a space between the structures formed on the first substrate, respectively, and the structures formed on the second substrate, respectively.

3. A method for fabricating a field emission display, comprising the steps of:

providing a first substrate;

forming a transparent electrode layer on the substrate;

forming an insulating layer on the transparent electrode layer;

forming a conductive layer of gate-material on the insulating layer;

selectively removing portions of the layer of gate-material to form a gate electrode;

selectively removing portions of the insulating layer to expose a predetermined area of the transparent electrode;

forming a fluorescent layer on the exposed area of the transparent electrode;

providing a second substrate;

forming a conductive cathode layer on the second substrate; and forming a tip for emitting electrons on a predetermined area of the conductive cathode layer.

4. A method in accordance with claim 3, wherein the step of forming a fluorescent layer includes:

forming a photoresist pattern on the gate electrode, depositing a layer of fluorescent material on the photoresist pattern and the exposed area of the transparent electrode layer; and removing the photoresist pattern and the fluorescent material thereon to leave the fluorescent layer only on the exposed area of the transparent electrode layer.

5. A method in accordance with claim 3, wherein said step of forming a tip comprises an etching process.

6. A method in accordance with claim 5, wherein said step of forming a tip includes:

depositing a tip layer on a conductive cathode layer;

forming a photoresist pattern on a predetermined area of the tip layer;

baking the photoresist pattern to reshape the photoresist pattern; and subjecting the baked photoresist pattern and the tip layer to reactive ion etching.

7. A method in accordance with claim 3, wherein the step of selectively removing portions of the conductive layer to form a gate electrode includes:

etching the conductive layer formed on the insulating layer.

8. A method in accordance with claim 2, wherein the step of selectively removing the insulating layer to expose a predetermined area of the transparent electrode includes:

etching the insulating layer formed on the transparent electrode.

9. A method in accordance with claim 3, wherein the steps of selectively removing portions of the insulating layer includes:

using the gate electrode as a mask.

10. A method of fabricating a field emission display, the method comprising the steps of:

providing a first substrate;

forming a conductive cathode layer on the first substrate;

forming a layer of conductive tip-material on the conductive cathode layer;

forming a photoresist pattern on the tip material layer;

baking the photoresist pattern to reshape the photoresist pattern;

selectively etching the tip-material layer such that an etching rate of a portion of the tip-material layer under the photoresist pattern is slower than an etching rate of a portion of the tip-material layer not covered by the photoresist pattern, to form a conductive tip, for emitting electrons, on a predetermined area of the conductive cathode layer and to otherwise expose the conductive cathode layer;

forming an insulating layer on the tip and the conductive cathode layer;

forming a layer of conductive gate-material on the insulating layer;

selectively removing a portion of the gate-material layer over the tip to form a gate electrode;

selectively removing a portion of the insulating layer over the tip using the gate electrode as a mask, resulting in the formation of an upper structure of the field emission display;

providing a second substrate;

forming a transparent electrode on the second substrate;

forming a fluorescent layer on a portion of the transparent electrode, resulting in the formation of a lower structure of the field emission device; and orienting the upper structure and the lower structure so the tip is opposed to the fluorescent layer and positioned a predetermined distance therefrom.

11. A method in accordance with claim 10, further comprising:

sealing a space formed between the upper and lower structures; and creating a vacuum in the space between the upper and lower structures.

12. A method in accordance with claim 10, further wherein the step of selectively etching the tip-material layer includes:

reactive ion etching the tip-material layer.

* * * * *